US010362838B2

(12) United States Patent
Fildan et al.

(10) Patent No.: US 10,362,838 B2
(45) Date of Patent: Jul. 30, 2019

(54) HOOK AND EYE FASTENER

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 239 days.

(21) Appl. No.: 15/609,193

(22) Filed: May 31, 2017

(65) Prior Publication Data

US 2018/0092439 A1 Apr. 5, 2018

(30) Foreign Application Priority Data

Oct. 3, 2016 (GB) ..... 1616804.9

(51) Int. Cl.
*A44B 13/00* (2006.01)
*A41F 1/00* (2006.01)

(52) U.S. Cl.
CPC ..... *A44B 13/0052* (2013.01); *A41F 1/002* (2013.01); *A41F 1/006* (2013.01); *A44B 13/00* (2013.01); *A44B 13/0047* (2013.01); *A41B 2300/326* (2013.01); *A41D 2300/326* (2013.01)

(58) Field of Classification Search
CPC ..... A44B 13/0023; A44B 13/0047; A44B 13/0052; A44B 13/007; A44B 13/0094; A41F 1/006; A41B 2300/326; A41D 2300/326; Y10T 24/32
See application file for complete search history.

(56) References Cited

U.S. PATENT DOCUMENTS 5,485,658 A * 1/1996 Fildan ..... A41F 1/006 24/614
6,857,169 B2 * 2/2005 Chung ..... A44B 11/258 24/303

FOREIGN PATENT DOCUMENTS

GB 2538109 11/2016

* cited by examiner

*Primary Examiner* — Abigail E Troy
(74) *Attorney, Agent, or Firm* — Kintner IP, LLC; Mary Frances Ludwig

(57) ABSTRACT

A hook and eye fastener for securing two pieces of a garment together includes a hook part for mounting on one of the pieces and an eye part for mounting on of the other of the pieces. The eye part comprises a frame having an open mouth defined by a circumferential lip. The lip has a pair of slots formed therein. The hook part comprises a body and arm. The arm comprises an inner portion connected to the body and an outer portion connected to inner portion. A plurality of ribs are provided along the rear surface of the inner portion and a pair of divider walls are provided along the front surface of the inner portion, nestled below the outer portion. The divider walls project forwardly for location in the slots of the lip. The fastener is relatively slim, easy to use, and capable of withstanding high tensile forces.

21 Claims, 4 Drawing Sheets

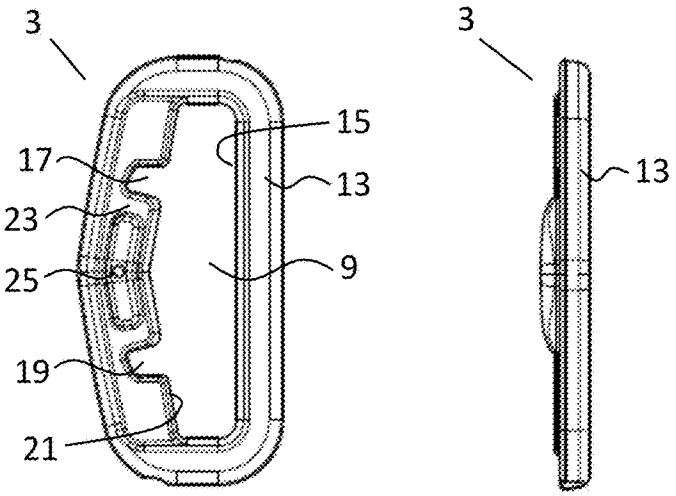
Fig. 5
Fig. 6
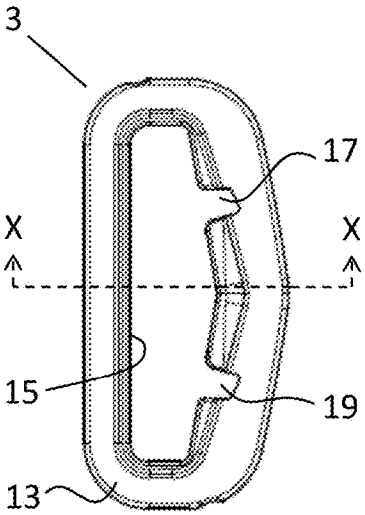
Fig. 7
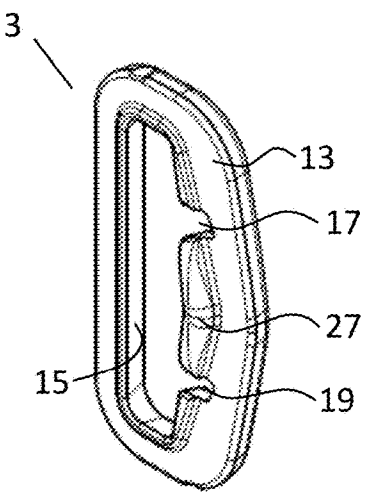
Fig. 8
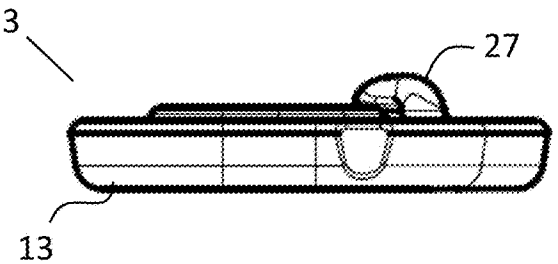
Fig. 9
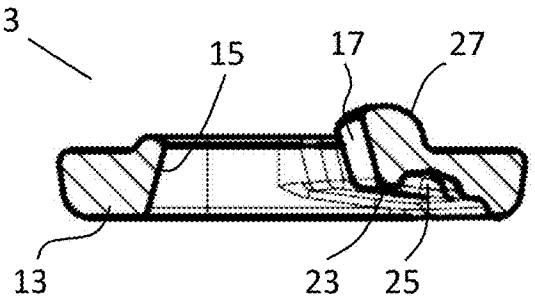
Fig. 10

HOOK AND EYE FASTENER

CROSS REFERENCE TO RELATED APPLICATION

This application is entitled to, and claims, a benefit of a right of priority under 35 U.S.C. § 119 from United Kingdom patent application 1616804.9, filed on 3 Oct. 2016, the content of which is incorporated by reference as if fully recited herein.

TECHNICAL FIELD

The present invention pertains generally to a hook and eye fastener for securing two pieces of a garment together. More specifically, the present invention relates to a hook and eye fastener particularly suited for securing two pieces of a brassiere together.

BACKGROUND OF THE INVENTION

Three of the main considerations when designing a fastener for a brassiere are strength, ease-of-use, and profile. The fastener must be sufficiently strong that it can withstand applied tensile forces, it must be easy for the user to manipulate, particularly if the fastener is located at the rear of the brassiere, and it preferably will have a low profile so that it is not highly visible through over-garments.

One such fastener that satisfies many of these criteria is described in the applicant's own co-pending UK Patent Application No. GB1507925.4 (UK Patent Application Publication No. GB2538109). The fastener described therein is particularly easy to manipulate, even by those with manual dexterity problems, and has a relatively low profile so that it is practically invisible under most over-garments. However, there is one shortcoming of the fastener described in GB1507925.4 in that when constructed with a low profile, the fastener is typically only able to withstand tensile forces of the order of 15 lbs to 20 lbs (6.80 kgs to 9.07 kgs). Although still useful, this limitation constrains the potential applications of the fastener.

For example, such a fastener is not particularly suited to sports brassieres (commonly referred to as "sports bras") or to brassieres of larger sizes, as these garments are typically subjected to higher tensile forces. Increased applied force could result in the brassiere inadvertently opening, leading to inconvenience, discomfort and/or embarrassment of the wearer.

It is an object of the present invention to provide a fastener that addresses at least some of the above-identified problems. It is a further object of the present invention to provide a fastener that is strong, easy to use, and that has a relatively low profile. It is a further still object of the present invention to provide a fastener for a garment that offers a useful choice to the consumer.

BRIEF SUMMARY OF THE INVENTION

A hook and eye fastener is provided for securing two pieces of a garment together, the hook part configured to be mounted on a face of one of the pieces and the eye part configured to be mounted on a face of the other of the pieces, in which:

the hook part comprises a substantially planar body configured to lay flat on the face of the piece of the garment and having an arm extending outwardly from the body, the arm comprising an inner portion connected to the body at a first end, the inner portion extending outwardly substantially perpendicular to the body, and an outer portion connected to a second end of the inner portion, the outer portion extending substantially parallel to the planar body, and a side of the outer portion facing towards the planar body defining a hook part abutment surface;

the eye part comprises a substantially planar frame configured to lay flat on the face of the other of the pieces of the garment, the frame defining an open mouth with a circumferential lip, the open mouth dimensioned to receive the outer portion of the arm of the hook part, and having an eye part abutment surface on an underside of the frame, the eye part abutment surface shaped complementary to the hook part abutment surface for engagement therewith; and, when the body of the hook part and the frame of the eye part are touching or closely juxtaposed, the eye part is slidably engageable with the hook part to bring the hook part abutment surface and the eye part abutment surface into engagement with each other and fasten the two pieces of the garment together when the hook part is mounted on one of the pieces and the eye part is mounted on the other one of the pieces; and, in which the open mouth of the eye part comprises a slot formed in the lip along a leading edge thereof, and the hook part comprises a divider wall located on an underside of the arm for engagement in the slot formed in the lip of the eye part, the divider wall extending downwardly and substantially perpendicular from the hook part abutment surface of the outer portion of the arm and forwardly and substantially perpendicular from a front surface of the inner portion of the arm.

By having such a fastener, the fastener will be simple to use and will have a relatively low profile resulting in the fastener being practically invisible under most garments. Perhaps more importantly, the fastener will be strong and will be able to withstand tensile forces on the order of 25 lbs to 30 lbs (11.34 kgs to 13.61 kgs), an increase in strength on the order of between 25%-100% on the closest existing offering. This increased strength greatly increases the number of potential applications for the fastener. For example, the fastener will be suitable for sports bras and for brassieres produced for women with larger breast sizes.

In one embodiment of the hook and eye fastener the slot and the divider wall are off-center with respect to the leading edge of the lip and the outer portion of the arm, respectively.

In one embodiment of the hook and eye fastener there are provided a pair of spaced-apart slots formed in the lip along a leading edge thereof and a pair of spaced-apart divider walls located on the underside of the arm each divider wall arranged and configured for engagement in one of the slots formed in the lip.

In one embodiment of the hook and eye fastener the pair of spaced-apart slots are spaced evenly about either side of the center of the leading edge of the lip and the pair of spaced-apart divider walls are spaced evenly about either side of the center of the outer portion of the arm. In this way, the loads will be spread more evenly across the fastener and the hook part will be less inclined to distort and consequently permit inadvertent release of the fastener under an applied force.

In one embodiment of the hook and eye fastener there is provided at least one rib formed along a rear surface of the inner portion of the arm. By providing at least one rib, and preferably a plurality of ribs, on the rear surface of the inner portion of the arm, the arm will have even less tendency to distort under an applied force. This will enable the fastener to be manufactured relatively thin without decreasing the strength of the fastener to the point where it is ineffective for many applications.

In one embodiment of the hook and eye fastener the rib extends upwardly from the substantially planar body along the rear surface of the inner portion of the arm.

In one embodiment of the hook and eye fastener there are provided a plurality of ribs spaced apart from each other along the rear surface of the inner portion of the arm.

In one embodiment of the hook and eye fastener the eye part further comprises an upstanding flange adjacent the eye part abutment surface. The flange will effectively act as a backstop for the outer portion of the hook part and this will facilitate location of the hook part in the eye part. This feature is particularly useful when the fastener is located to the rear of the garment.

In one embodiment of the hook and eye fastener there are provided a plurality of eye parts mounted in a row along the piece of garment. This will provide good adjustability to the garment allowing for variation in body shapes and sizes.

In one embodiment of the hook and eye fastener the piece of the garment where the eye part is mounted comprises a pair of sheets of fabric and the eye part is sandwiched between the pair of sheets of fabric. This is seen as a particularly simple construction yet it will obviate the possibility of the fastener causing irritation to the wearer.

In one embodiment of the hook and eye fastener the one of the pair of sheets of fabric sandwiching the eye part that lies substantially above the eye part is welded to the eye part with ripples in the sheet of fabric. By welding the sheet to the eye part with ripples (i.e. by leading the sheet back over on itself in places) in the sheet of fabric, the engagement of the eye part with the sheet has been found to be more robust and capable of withstanding higher forces.

In one embodiment of a hook and eye fastener the eye part is constructed from polyamide 6.6. Alternatively, the hook and eye fastener may be constructed from polyamide 6. Polyamide 6.6 in combination with the rippled welding is seen as particularly effective for those application that require strength such as sports bras and bikinis whereas polyamide 6 is seen as more suitable for those applications that require a more refined, smoother finish such as lingerie.

In one embodiment of a hook and eye fastener a pocket is formed between the abutment surface on the underside of the frame of the eye part and the face of the piece on which it is mounted.

In one embodiment of the hook and eye fastener there is provided a boss on one of the hook part abutment surface and the eye part abutment surface and a dimple shaped complementary to the boss on the other of the hook part abutment surface and the eye part abutment surface. The boss and dimple will co-operate with each other to more securely fasten the hook part and eye part together and prevent inadvertent release of the fastener. These are relatively simple to manufacture as they can be molded into the hook and eye components.

In one embodiment of the hook and eye fastener the boss is mounted on the hook part abutment surface.

In one embodiment of the hook and eye fastener the boss and the complementary dimple are located substantially centrally relative to the leading edge of the lip and the outer portion of the arm.

In one embodiment of the hook and eye fastener the outer portion is chevron shaped. This is seen as a useful embodiment of the present invention as the chevron shape will help guide the hook into a central location in the eye, ensuring correct alignment and engagement of the hook and eye.

In one embodiment of a hook and eye fastener the eye part abutment surface on the underside of the frame for engagement of the hook part abutment surface is chevron-shaped. This will also promote correct location of the hook part in the eye part and will help to create a secure engagement therebetween.

In one embodiment of the hook and eye fastener the hook part and eye part each comprise a complementary magnet for location of the hook part outer portion in the open mouth of the eye part. Magnets are advantageous as they will further simplify the engagement of the hook and eye into the finder position thereby simplifying the closure of the fastener. This feature is particularly helpful when the fastener is located at the rear of the garment behind the wearer's back.

In one embodiment of the hook and eye fastener the magnet on the hook part is located on the body rearward of the arm and the magnet on the eye part is located in the frame rearward and remote from the abutment surface. By placing the magnets in these areas, the depth dimensions of the hook and eye can be kept relatively thin to ensure that the overall thickness of the fastener is not increased.

In one embodiment of the hook and eye fastener at least one of the pieces is elasticated.

In one embodiment of the hook and eye fastener there is provided only one hook. This is advantageous as it will facilitate the closure of the fastener about the wearer. This is made possible in part by the structural integrity of the configuration of hook.

In one embodiment of a hook and eye fastener at least one of the pieces is provided with padding. Preferably, if padding is provided, the piece having the eye parts will be padded as this will enable the padding to be spread across the back of the wearer (if the fastener is positioned to the rear of the wearer). Padding is particularly advantageous in sports bra applications.

Further provided is a garment including a hook and eye fastener substantially as described herein.

Other embodiments, in addition to the embodiments enumerated above, will become apparent from the following detailed description, taken in conjunction with the accompanying drawings, which illustrate, by way of example, the principles of the fastener and method of use.

BRIEF DESCRIPTION OF THE DRAWINGS

FIG. 5 is a front view of the eye part without a garment piece connected thereto.

FIG. 6 is a side view of the eye part of FIG. 5.

FIG. 7 is a rear view of the eye part of FIG. 5.

FIG. 8 is a perspective view of the eye part of FIG. 5.

FIG. 9 is an enlarged end view of the eye part of FIG. 5.

FIG. 10 is an enlarged cross-sectional view along the line X-X of FIG. 7.

DETAILED DESCRIPTION OF THE INVENTION

Figure 1:
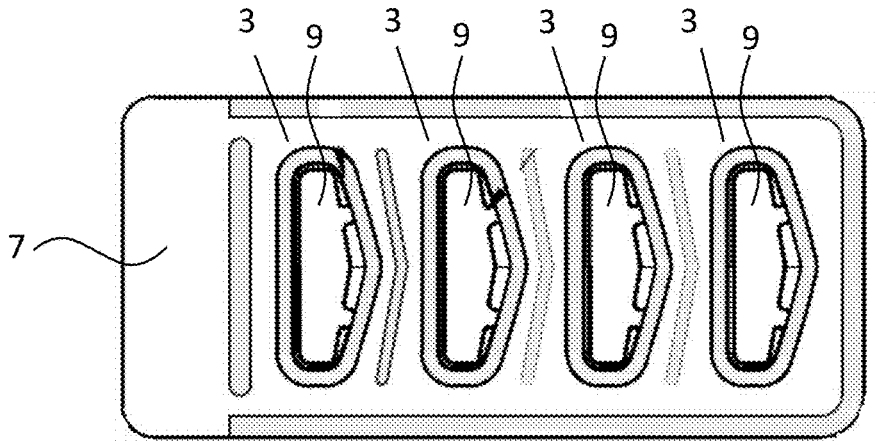
FIG. 1 is a rear view of an eye part of a fastener.

Referring to FIGS. 1-17, there is shown a hook and eye fastener, indicated generally by the reference numeral 1, comprising an eye part 3 and a hook part 5. Typically, the eye part 3 will be mounted closest to the body of the wearer and the hook part 5 will be mounted further from the body of the wearer. Furthermore, the fastener will typically be located to one side or, more usually, to the rear of the wearer's torso. Therefore, throughout this specification, the examples are described in terms where the fastener 1 is located at the back of a wearer with the eye part 3 located adjacent the wearers body and the hook part 5 rearward of the eye part. It will be understood that front, back, forward, rearward, and equivalent terms when referring to the orientation of the eye part 3 or the hook part 5 have been used with such an embodiment in mind. However, this embodiment is not limiting and the fastener could be at the wearer's side or front of their torso and the hook part could be mounted closest to the wearer's skin, in which case the terms front, back, forwards, and rearwards will be altered accordingly.

Referring specifically to FIG. 1, there are shown a plurality of eye parts 3, in this case four of eye part 3, mounted in a row on a fabric piece 7 of a garment (not shown). The eye parts are welded to the fabric piece and in fact are welded between two sheets of fabric, one of which is below the eye parts 3 and the other of which is substantially above the eye parts 3. The sheet substantially above the eye parts 3 is free of the open mouths 9 of the eye parts 3 and the sheet below the eye parts 3 provides a backing sheet to the eye part, thereby effectively forming a pocket between the eye part and the backing sheet.

Figure 2:
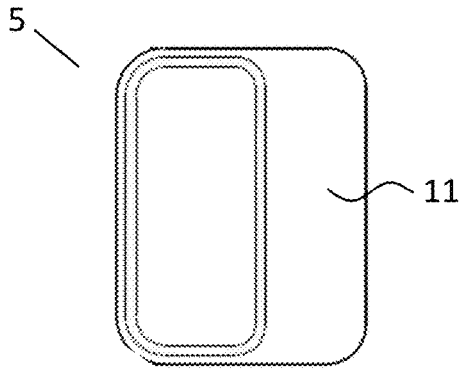
FIG. 2 is a rear view of a hook part of the fastener.
Figure 3:
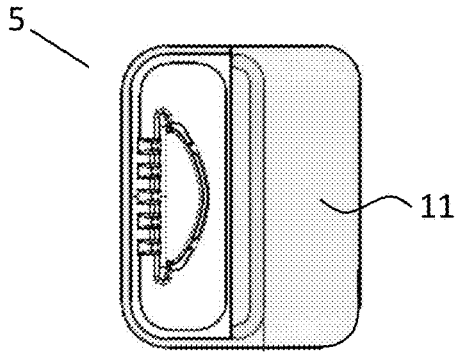
FIG. 3 is a front view of the hook part of FIG. 2.

Referring to FIGS. 2 & 3, there are shown a hook part 5 mounted on a fabric piece 11 of a garment (not shown). The hook part 5 is welded in place on the fabric piece. The various features of the hook part 5 will be described in more detail with reference to FIGS. 11-17 below.

Referring specifically to FIGS. 5-10, there are shown various views of the eye part 3 of the fastener 1. The eye part 3 comprises a substantially planar frame 13 defining an open mouth 9. The open mouth has a circumferential lip 15 and there is further provided a pair of slots 17, 19 formed in the lip 15 along a leading edge 21 thereof. An eye part abutment surface 23 is formed on the underside of the frame forward of the leading edge 21 of the lip 15 and a dimple 25 is formed in the eye part abutment surface 23. Finally, there is provided a raised flange 27 intermediate the pair of slots 17, 19.

Referring specifically to FIGS. 11-17, there are shown various views of the hook part 5 of the fastener 1. The hook part 5 comprises a substantially planar body 29 having an arm 31 extending outwardly from the body 29. The arm 29 comprises an inner portion 33 connected at one end to the body and extending outwardly substantially perpendicular to the body and an outer portion 35 connected to the other end of the inner portion 33 and extending substantially parallel to the planar body. The side of the outer portion 35 facing towards the planar body defines a hook part abutment surface 37. A boss 39 is formed in the hook part abutment surface 37 for engagement of the dimple 25 of the eye part 3.

Importantly, the hook part 5 comprises a pair of divider walls 41, 43 located on the underside of the arm for engagement in the slots 17, 19 formed in the lip 15 of the eye part 3. The divider walls 41, 43 extend downwardly and substantially perpendicular from the hook part abutment surface 37 of the outer portion 35 of the arm 31 and forwardly and substantially perpendicular from a front surface 45 of the inner portion 33 of the arm 31. In addition to the divider walls 41, 43, there are provided a plurality of ribs 47 on the rear surface 49 of the inner portion 33 extending upwardly from the body 29 along the inner portion 33 towards the outer portion 35. In combination, the divider walls 41, 43 and the ribs 47 provide greater structural rigidity to the hook part 5. In this way, the hook part is capable of withstanding higher tensile forces applied thereto and the hook part will not have a tendency to bend out of shape and inadvertently release from the eye part 3. Furthermore, the manner in which the divider walls 41, 43 engage the slots 17, 19 also provides greater strength to the fastener 1 and obviates the likelihood of the hook part 5 becoming inadvertently dislodged from the eye part 3.

Figure 4:
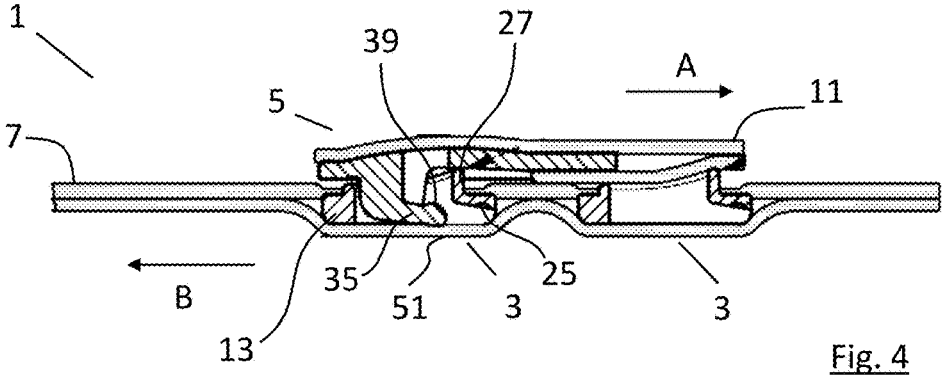
FIG. 4 is a cross-sectional view of the hook part and eye part of the fastener in a finding position prior to full engagement.
Figure 15:
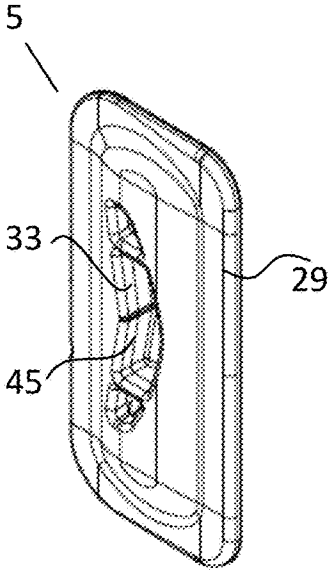
FIG. 15 is a rear perspective view of the hook part of FIG. 11.
Figure 14:
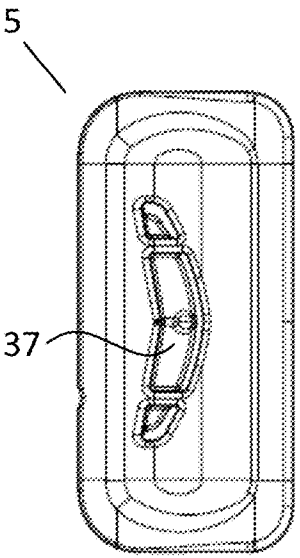
FIG. 14 is a rear view of the hook part of FIG. 11.
Figure 13:
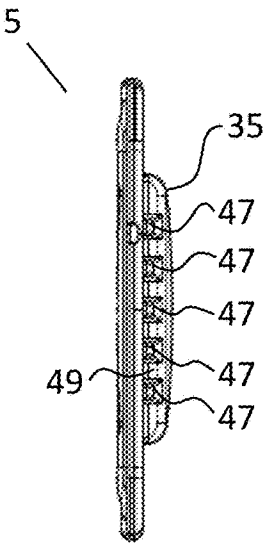
FIG. 13 is a left side view of the hook part of FIG. 11.
Figure 11:
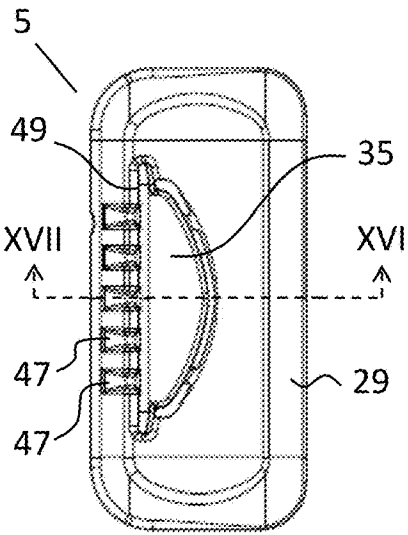
FIG. 11 is a front view of the hook part without a garment piece connected thereto.
Figure 12:
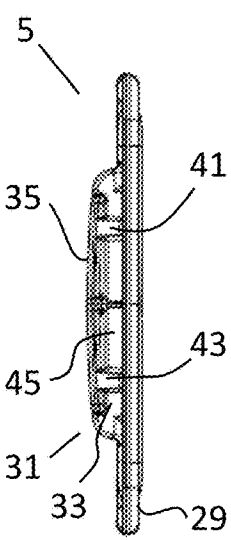
FIG. 12 is a right side view of the hook part of FIG. 11.
Figure 17:
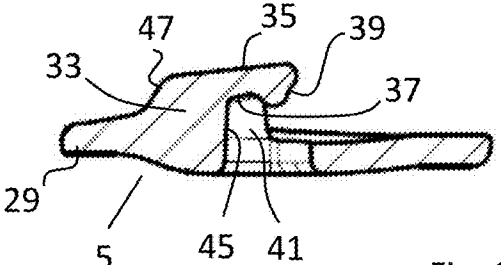
FIG. 17 is an enlarged cross-sectional view along the line XVII-XVII of FIG. 11.
Figure 16:
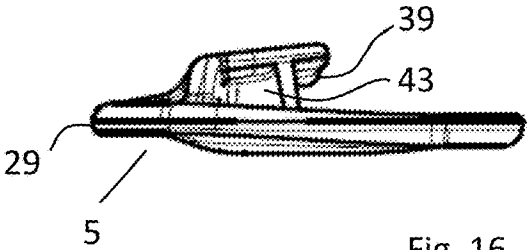
FIG. 16 is an enlarged end view of the hook part of FIG. 11.

Referring now to FIG. 4, there is shown a fastener 1 with the hook part 5 and the eye part 3 in a finding position prior to engagement. In order to get the fastener 1 into such a configuration, the outer portion 35 of the hook part 5 has been passed through into the open mouth 9 of the eye part 3 (see FIG. 5). In the embodiment shown in FIG. 4, only two of the eye parts 3 have been shown for clarity, however, it will be understood that one or more than two eye parts 3 could be provided if desired.

Once in the finding position of FIG. 4, with the hook and eye in close juxtaposition with respect to each other, the hook part 5 and the eye part 3 are brought into engagement with each other by sliding the hook part in the direction of arrow A and by simultaneously sliding the eye part 3 in the direction of arrow B. In doing so, the outer portion 35 of the hook part 5 will slide underneath part of the frame 13 of the eye part 3 and the boss 39 will locate in the dimple 25. At the same time, the divider walls 41, 43 of the hook part 5 will each locate in one of the slots 17, 19 of the eye part 3. The fact that the circumferential lip 15 of the eye part 3 is curved will assist in the placement of the boss 39 in the dimple 25 and the divider walls 41, 43 in the slots 17, 19. The eye part abutment surface 23 will be in engagement with the hook part abutment surface 37. The hook part abutment surface 37 will be urged towards the eye part abutment surface 23 by the fabric backing sheet 51, and separation of the eye part 3 from the hook part 5 will be resisted by the boss 39 and the dimple 25, in conjunction with the normal tensile force applied by virtue of the garment being worn. Preferably, at least one of fabric pieces 7 and 11 is elasticated.

Release of the eye part 3 from the hook part 5 may be effected by overcoming the applied tensile force and the force of the boss 39 in the dimple 25 by pulling the hook part in the direction of arrow B and by simultaneously sliding the eye part in the direction of arrow A and then moving the two pieces away from each other.

It will be appreciated that in order to get into the finding position illustrated in FIG. 4, the outer portion 35 of the hook part 5 is slid along the eye part 3 until the forwardmost part of the outer portion 35 abuts against the raised flange 27 at the entrance of the eye part. The outer portion 35 of the hook part 5 is then pushed inwardly through the open mouth 9 of the eye part 3, whereupon the eye part 3 and the hook part 5 will be in the finding configuration.

Figure 18:
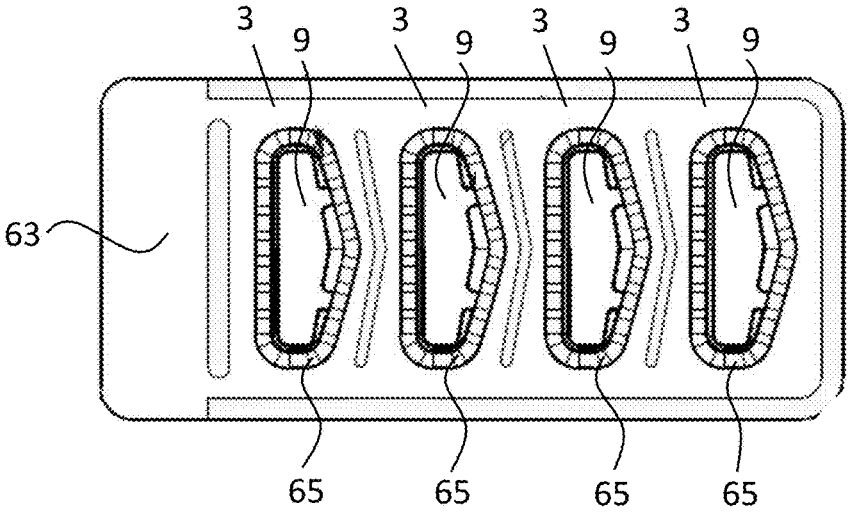
FIG. 18 is a rear view of an alternative embodiment of the eye part of the fastener.
Figure 19:
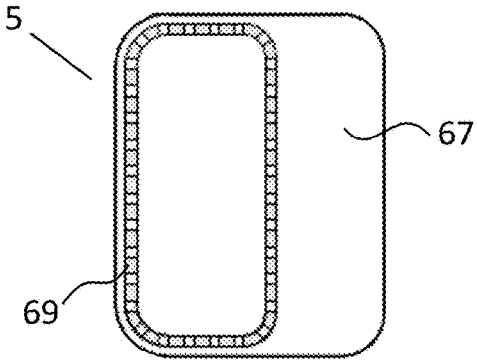
FIG. 19 is a rear view of an alternative embodiment of the hook part of the fastener.
Figure 20:
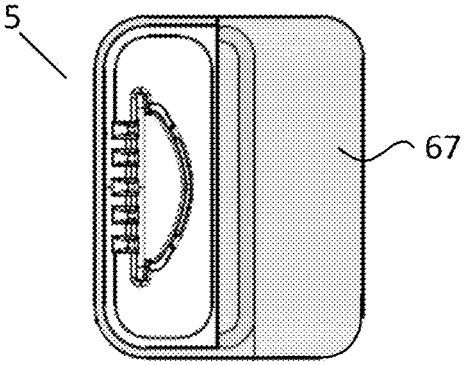
FIG. 20 is a front view of the hook part of FIG. 19.
Figure 21:
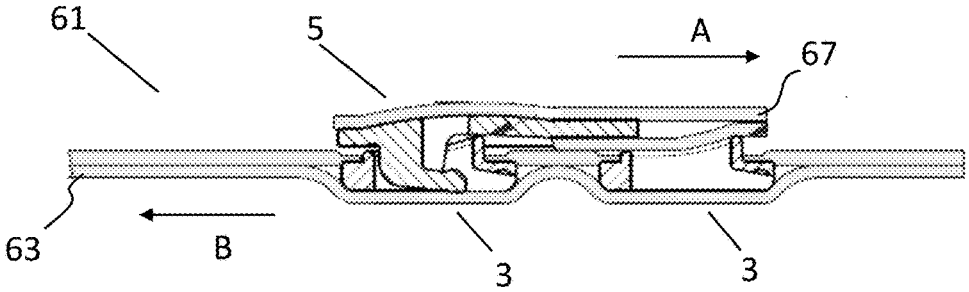
FIG. 21 is a cross-sectional view of the eye part and hook part of FIGS. 18 & 19, respectively, in a finding position prior to full engagement.

Referring now to FIGS. 18-21, there are shown a plurality of representations, similar to FIGS. 1-4, of an alternative embodiment of the fastener, indicated generally by the reference numeral 61, where like parts have been given the same reference numeral as before. Referring specifically to FIG. 18, the fastener comprises a piece of fabric 63 on which a plurality of eye parts 3 are mounted. The piece 63 differs from the piece 7 in that the eye parts 3 are welded to the piece in a rippled fashion 65. This rippling entails small folds of the fabric material being led back on itself before being welded to the eye part below. Referring specifically to FIG. 19, there is shown a rear view of the hook part 5. The hook part 5 comprises a fabric piece 67 and the hook part 5 is also ripple welded along seam 69 to the fabric piece 67, using ultrasonic welding techniques.

In the embodiment shown in FIGS. 18 to 21, the hook part 5 and the eye part 3 are preferably constructed from polyamide (PA) 6.6, whereas in the embodiment shown in FIGS. 1-17, the hook part and the eye part may be constructed from PA 6 or like material. The ripple welding in combination with PA 6.6 provides increased strength in higher stress applications, such as for sports bras, as the PA 6.6 is marginally stiffer than the PA 6, and the ripple welding provides greater strength than alternative welding techniques. In the embodiment shown in FIGS. 1-17, the material used for the eye part 3 and the hook part 5 may be PA 6 which is smoother and preferred for applications such as lingerie where improved comfort over an extended period of time may be prioritized.

In the embodiments shown, there are two divider walls 41, 43 and five ribs 47 on the hook part 5 along with two slots 17, 19 on the eye part 3. Furthermore, there is a single boss 39 on the hook part 5 and a single dimple 25 on the eye part 3. These are not limiting unless otherwise specified in the claims, and it will be understood that more or fewer divider walls and corresponding slots may be provided, more or fewer ribs may be provided, and more or fewer bosses and dimples may be provided, if desired. Furthermore, the positioning of the divider wall(s), the slot(s), the rib(s), the boss(es) and the dimple(s) may be varied, if desired, and unless otherwise stipulated by the claims.

It will be seen from the foregoing examples, that the hook and eye fasteners according to the embodiments shown have only a single hook as opposed to a plurality of hooks as is common in the known fasteners. This is seen as a highly advantageous aspect of the present invention. Generally speaking, the hook and eye fasteners known in the art comprise a column of two or more hooks and several columns of two or more corresponding eyes, depending on the width of the back of the garment. In some cases, five or more hooks aligned in a vertical column may be provided. Such hooks have to be closed one at a time, which is difficult and cumbersome for the wearer, and it is often difficult to align the hooks correctly with the corresponding eyes. As a consequence, the hooks and eyes are often misaligned or the hooks and eyes have to be located first into the outermost position before the hooks are thereafter adjusted and inserted into the desired correctly fitting position. The overall thickness of the hook and eye fastener shown is of the order of 5 mm (0.005 m) or less. In the embodiment shown in FIG. 4, the actual thickness of the fastener (hook part and eye part combined) is 4.7 mm (0.0047 m). It will be appreciated that such a fastener is strong, thin, and relatively simple to use.

Further provided is a garment including a hook and eye fastener as described herein.

The embodiments of the fastener and garment described herein are exemplary and numerous modifications, combinations, variations, and rearrangements can be readily envisioned to achieve an equivalent result, all of which are intended to be embraced within the scope of the appended claims. Further, nothing in the above-provided discussions of the fastener and garment should be construed as limiting the invention to a particular embodiment or combination of embodiments. The scope of the invention is defined by the appended claims.

The invention claimed is:

1. A hook and eye fastener for securing two pieces of a garment together, the fastener comprising:

a hook part configured to be mounted on a face of one of the pieces of the garment, the hook part comprising a substantially planar body configured to lay flat on the face of the piece of the garment, and an arm extending outwardly from the body, the arm comprising an inner portion connected to the body at a first end, the inner portion extending outwardly substantially perpendicular to the body, and an outer portion connected to a second end of the inner portion, the outer portion extending substantially parallel to the planar body, and a side of the outer portion facing towards the planar body defining a hook part abutment surface;

an eye part configured to be mounted on a face of the other one of the pieces of the garment, the eye part comprising a substantially planar frame configured to lay flat on the face of the other of the pieces of the garment, the frame defining an open mouth with a circumferential lip, the open mouth dimensioned to receive the outer portion of the arm of the hook part, and having an eye part abutment surface on an underside of the frame, the eye part abutment surface shaped complementary to the hook part abutment surface for engagement therewith;

when the body of the hook part and the frame of the eye part are touching or closely juxtaposed, the eye part is slidably engageable with the hook part to bring the hook part abutment surface and the eye part abutment surface into engagement with each other and fasten the two pieces of the garment together when the hook part is mounted on one of the pieces and the eye part is mounted on the other one of the pieces; and, wherein the open mouth of the eye part comprises a slot formed in the lip along a leading edge thereof, and the hook part comprises a divider wall located on an underside of the arm for engagement in the slot formed in the lip of the eye part, the divider wall extending downwardly and substantially perpendicular from the hook part abutment surface of the outer portion of the arm and forwardly and substantially perpendicular from a front surface of the inner portion of the arm.

2. The hook and eye fastener of claim 1, wherein the slot of the eye part is off-center with respect to the leading edge of the lip and the divider wall of the hook part is off-center with respect to the outer portion of the arm.

3. The hook and eye fastener of claim 1, wherein the eye part comprises a pair of slots formed in the lip along a leading edge thereof, the slots spaced apart from one another, and the hook part comprises a pair of divider walls located on the underside of the arm, the divider walls spaced apart from one another, each divider wall arranged and configured for engagement in one of the slots formed in the lip.

4. The hook and eye fastener of claim 3, wherein the pair of slots are spaced evenly about either side of the center of the leading edge of the lip and the pair of divider walls are spaced evenly about either side of the center of the outer portion of the arm.

5. The hook and eye fastener of claim 1, wherein there is provided at least one rib formed along a rear surface of the inner portion of the arm.

6. The hook and eye fastener of claim 5, wherein the rib extends upwardly from the substantially planar body along the rear surface of the inner portion of the arm.

7. The hook and eye fastener of claim 5, wherein there are provided a plurality of ribs spaced apart from each other along the rear surface of the inner portion of the arm.

8. The hook and eye fastener of claim 1, wherein the eye part further comprises an upstanding flange adjacent the eye part abutment surface.

9. The hook and eye fastener of claim 1, wherein there is provided a boss on one of the hook part abutment surface and the eye part abutment surface, and a dimple shaped complementary to the boss on the other of the hook part abutment surface and the eye part abutment surface.

10. The hook and eye fastener of claim 9, wherein the boss is mounted on the hook part abutment surface.

11. The hook and eye fastener of claim 9, wherein the boss and the complementary dimple are located substantially centrally relative to the leading edge of the lip and the outer portion of the arm.

12. The hook and eye fastener of claim 1, wherein the outer portion of the arm of the hook part is chevron shaped.

13. The hook and eye fastener of claim 12, wherein the eye part abutment surface of the frame for engagement of the hook part abutment surface is chevron-shaped.

14. The hook and eye fastener of claim 1, wherein the hook part and eye part each comprise a complementary magnet for location of the hook part outer portion in the open mouth of the eye part.

15. The hook and eye fastener of claim 14, wherein the magnet on the hook part is located on the body rearward of the arm, and the magnet on the eye part is located in the frame rearward of and remote from the abutment surface.

16. A garment comprising:

a first piece and a second piece configured to be secured together with a hook and eye fastener, the fastener comprising:

a hook part mounted on a face of one of the pieces of the garment, the hook part comprising a substantially planar body laid flat on the face of the piece of the garment, and an arm extending outwardly from the body, the arm comprising an inner portion connected to the body at a first end, the inner portion extending outwardly substantially perpendicular to the body, and an outer portion connected to a second end of the inner portion, the outer portion extending substantially parallel to the planar body, and a side of the outer portion facing towards the planar body defining a hook part abutment surface;

an eye part mounted on a face of the other one of the pieces of the garment, the eye part comprising a substantially planar frame laid flat on the face of the other of the pieces of the garment, the frame defining an open mouth with a circumferential lip, the open mouth dimensioned to receive the outer portion of the arm of the hook part, and having an eye part abutment surface on an underside of the frame, the eye part abutment surface shaped complementary to the hook part abutment surface for engagement therewith;

when the body of the hook part and the frame of the eye part are touching or closely juxtaposed, the eye part is slidably engageable with the hook part to bring the hook part abutment surface and the eye part abutment surface into engagement with each other and fasten the two pieces of the garment together when the hook part is mounted on one of the pieces and the eye part is mounted on the other one of the pieces; and, wherein the open mouth of the eye part comprises a slot formed in the lip along a leading edge thereof, and the hook part comprises a divider wall located on an underside of the arm for engagement in the slot formed in the lip of the eye part, the divider wall extending downwardly and substantially perpendicular from the hook part abutment surface of the outer portion of the arm and forwardly and substantially perpendicular from a front surface of the inner portion of the arm.

17. The garment of claim 16, wherein there are provided a plurality of eye parts mounted in a row along the piece of garment.

18. The garment of claim 16, wherein the piece of the garment where the eye part is mounted comprises a pair of sheets of fabric and the eye part is sandwiched between the pair of sheets of fabric.

19. The garment of claim 18, wherein the one of the pair of sheets of fabric sandwiching the eye part that lies substantially above the eye part is welded to the eye part with ripples in the sheet of fabric.

20. The garment of claim 19, wherein the eye part is constructed from polyamide 6.6.

21. The garment of claim 16, wherein a pocket is formed between the eye part abutment surface of the frame of the eye part and the face of the piece of the garment on which the eye part is mounted.

* * * * *